US005108326A

United States Patent [19]

Seiler

[11] Patent Number: 5,108,326

[45] Date of Patent: Apr. 28, 1992

[54] FLEXIBLE SURFACE DROGUE/STABILIZER FOR DRIFTER BUOYS

[75] Inventor: Joseph H. Seiler, Bedford, Canada

[73] Assignee: Seimac Limited, Dathmouth, Canada

[21] Appl. No.: 665,347

[22] Filed: Mar. 5, 1991

[51] Int. Cl.[5] ..... B63B 22/18

[52] U.S. Cl. ..... 441/22; 114/122; 114/311

[58] Field of Search ..... 441/21, 22, 30, 32, 441/33, 34, 1, 6; 114/311, 122, 126

[56] References Cited

U.S. PATENT DOCUMENTS

| | | | |
|---|---|---|---|
| 897,101 | 8/1908 | Heyn | 441/22 |
| 3,161,896 | 12/1964 | Holt et al. . | |
| 3,191,202 | 6/1965 | Handler . | |
| 3,646,505 | 2/1972 | Kirby | 441/22 |
| 3,711,821 | 1/1973 | Dale et al. | 441/22 |
| 3,755,836 | 9/1973 | Milazzo . | |
| 3,851,348 | 12/1974 | Gilbert et al. . | |
| 3,864,772 | 2/1975 | Gogolick et al. . | |
| 3,889,224 | 6/1975 | Reed et al. | 441/33 |
| 4,004,308 | 1/1971 | Gongwer . | |
| 4,004,309 | 1/1977 | Gongwer . | |
| 4,007,505 | 2/1977 | Nowatzki . | |
| 4,330,895 | 5/1982 | Putman et al. | 441/22 |

FOREIGN PATENT DOCUMENTS

| | | | |
|---|---|---|---|
| 305040 | 3/1989 | European Pat. Off. | 441/1 |
| 1163180 | 2/1964 | Fed. Rep. of Germany | 441/1 |

*Primary Examiner*—Sherman Basinger
*Assistant Examiner*—Thomas J. Brahan
*Attorney, Agent, or Firm*—Robert M. Phipps

[57] ABSTRACT

The invention relates generally to the stabilization of drifter buoys and the like and more particularly to surface or near surface Lagrangian Drifter Buoys launched from aircraft or surface vehicles and to an underwater suspension system adapted for stabilizing and maintaining the buoy at a predetermined depth in an upright position. The suspension assembly for use in combination with a buoy, having a generally elongated cylindrical hull, is comprised of two main components including 1) a collapsible longitudinal stabilizer means for providing horizontal drag and 2) a vertical stabilizer means suspended below and transverse the axis of the buoy. These two components act together to maintain the buoy in an upright position and to maintain it within the layer of water in which it is placed. The assembly is also compliant and as such the assembly has the ability to function for extended periods of time without the need for the use of inordinately strong or expensive materials.

18 Claims, 4 Drawing Sheets

FLEXIBLE SURFACE DROGUE/STABILIZER FOR DRIFTER BUOYS

The present invention relates generally to the stabilization of drifter buoys and the like and more particularly to surface and near Surface Lagrangian Drifter Buoys (SLDB) launched from aircraft or surface vehicles and to a suspension system adapted for stabilizing and maintaining the buoy at a predetermined depth, most preferably within the layer of water to about 1 meter below the surface of the water.

It is to be understood at the outset that this system preferably is to maintain the SLDB at the water's surface, however, its use at depths below the surface is also envisioned.

It will be seen that a Surface Lagrangian Drifter Buoy (SLDB) assembly of the present invention may be most preferably utilized for stabilization of a buoy within the layer of water in which it is placed and for obtaining and storing or transmitting of data related to the movement of the layer of water. Other applications however are also envisioned including, if desired, the monitoring of environmental conditions or the projection or transmission of sound waves etc.

Conventional buoys have been utilized in prior art applications to carry both electronic gear to measure the environmental conditions of the sea and radio transmitters with antennae to transmit this data to a remote receiver. Although these conventional buoys accomplish this task, they do not possess the ability to remain deployed within the surface or near surface layer of water in which they are placed thereby having a negative effect on the ability for accurate monitoring of the conditions of the water layer. The prior buoys tend to "slip" and thus do not remain within the layer of water which is to be monitored. Thus, the prior art buoys fail to satisfactorily provide sustained positioning required for accurate monitoring of the movement of the water layer and, secondarily, when antennae are deployed, fail to provide the stability required to ensure an accurate transmission angle of the desired data. The Surface Lagrangian Drifter Buoy of the present invention attempts to overcome the deficiencies found in the prior art buoys.

The average Lagrangian performance is achieved by stabilizer apparatus or assembly which holds the buoy within the water layer of interest and to minimize water from "sipping by" it. That is, if there is zero slip then the unit follows the surface layer exactly. The term "Lagrangian" refers here to a drifter buoy that follows the motion of the water in which it is floating.

The ocean generally is a dynamic environment, its surface subject to many factors including the effects of wind. On a smaller scale, that of centimeters, the ocean surface is a myriad of flows, some circular, some vertical, some horizontal, which combine to produce average horizontal drift velocities. The primary function of the SLDB is to track the net horizontal component.

If a body has infinite resistance to the passage of water then any movement of the water will take the body with it. The arrangement of the stabilizer assembly of the SLDB is such that the horizontal drag at the level of the body of water of interest is much greater than the drag acted on by other forces, such as water at deeper depths or wind above the surface. Since, as noted above, one of the principal applications of a buoy such as the SLDB is for ocean data collection, appendages above the surface, such as antennae or a sensor mast, and below, such as a sensor or sensor string, will normally be present. By making the drag of the SLDB around the desired depth range relatively large the effect of adding appendages outside of the layer of interest is minimized. The desired stability of the buoy within the desired layer of water is realized by providing a stabilizer assembly which facilitates horizontal drag thereby facilitating maintenance of the buoy and its related assembly within the desired water layer and, also, a vertical stabilizer further impeding the vertical motion of the buoy. Furthermore, when the buoy is deployed at the water's surface, the assembly functions to maintain the buoy and the assembly itself within the surface layer of the water.

The maintenance of the buoy within the layer of water to be monitored is achieved by the buoy and related assembly of the present invention through its "kinetic" design. The unique arrangement allows the device to comply with the environment in which it is placed. In contrast, a rigid design, as is the case in many prior art apparatus, would experience increased stress created by the turbulence of the water in which it is placed and thus maintenance of the buoy within the layer of water would be greatly hindered as well as the survival of the assembly or apparatus itself.

SUMMARY STATEMENT OF THE INVENTION

According to the invention, there is provided an apparatus for use in combination with a buoy having a generally elongated cylindrical hull for maintaining the buoy at a substantially predetermined depth in water and for orientation of the buoy with its longitudinal axis in a substantially vertical position, the apparatus comprising collapsible longitudinal stabilizer means for providing horizontal drag for facilitating and maintaining horizontal placement of the buoy and related assembly within the desired layer of water and a vertical stabilizer means suspended below and transverse of the longitudinal axis of the buoy for impeding the vertical motion thereof. Preferably the vertical stabilizer means is collapsible and is suspended from the longitudinal stabilizer means.

In a further aspect of the present invention there is provided an apparatus for use in combination with a buoy having a generally elongated cylindrical hull, the apparatus being adapted for maintaining the buoy at a substantially predetermined depth in water and for orientation of the buoy with its longitudinal axis in a substantially vertical position at the predetermined depth, the apparatus comprising a collar secured about the elongated cylindrical hull, the collar having a plurality of radial battens pivotally connected thereto, the battens presenting a multiplicity of outwardly projecting apices equidistant from a common center and radially spaced in a common plane substantially perpendicular to the longitudinal axis of the elongated cylindrical hull when in the erect position, a plurality of flexible vanes or sails mounted on the battens and projecting downwardly on the hull presenting longitudinal vane means facilitating maintenance of the buoy and related assembly within the desired body of water;

and a dampening element invertedly suspended via shroud lines to the apices of the radial battens for impeding the vertical motion of the buoy.

BRIEF DESCRIPTION OF THE DRAWINGS

Other objects and many of the intended advantages of this invention will be readily appreciated as the same becomes better understood by reference to the following detailed description when considered in connection with the accompanying drawings in which like reference numerals designate like parts throughout the figures thereof and wherein.

DETAILED DESCRIPTION OF THE INVENTION

Figure 1:
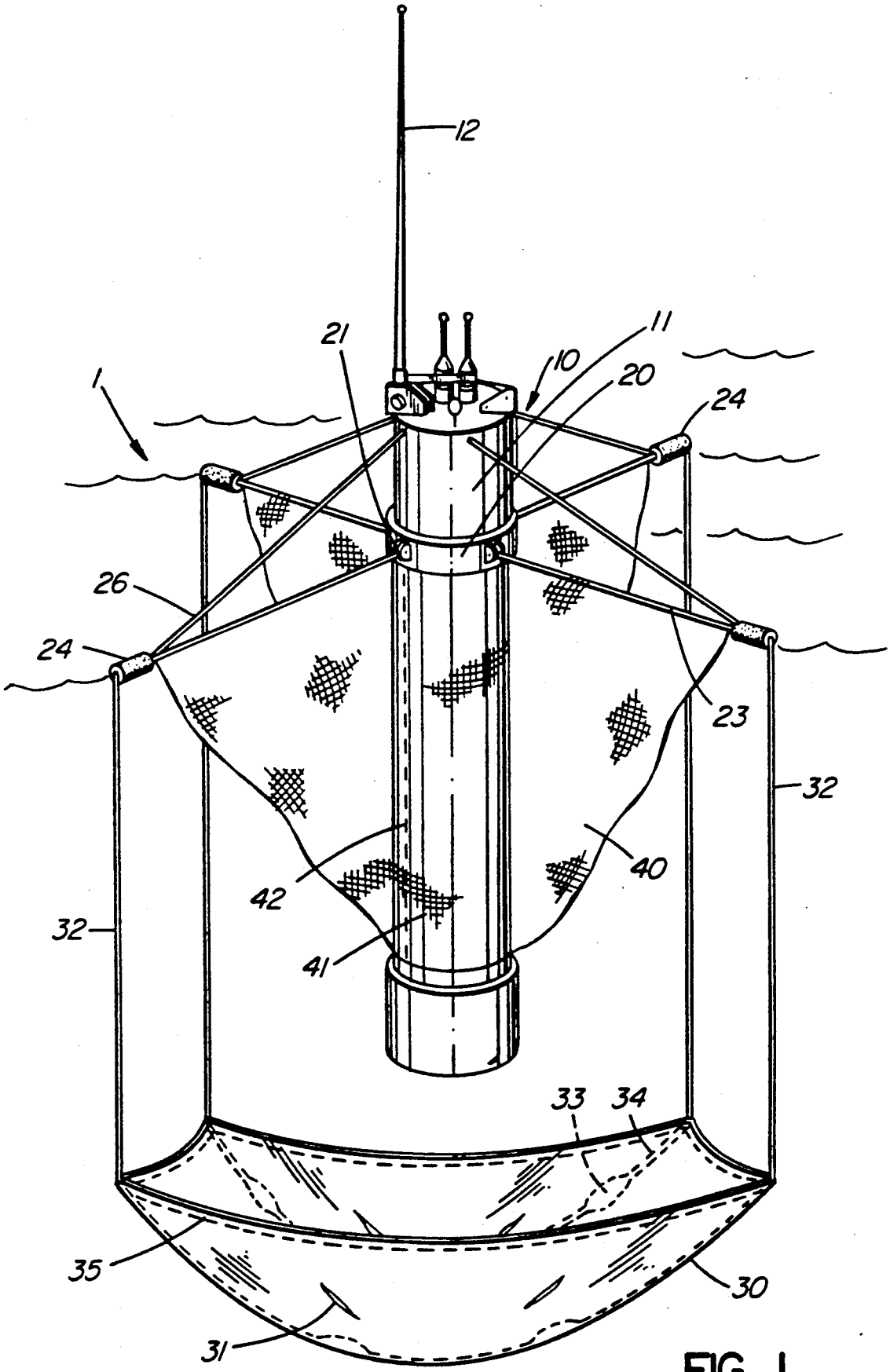
FIG. 1 is a perspective view of one embodiment of a drifter buoy as a Surface Lagrangian Drifter Buoy (SLDB) employing four vanes for producing horizontal drag.

Referring now to the drawings in which the same or corresponding parts are identified by the same number, there is shown in FIG. 1 illustrates the apparatus or assembly 1 of the present invention for use in combination with a drifter buoy 10 having a generally elongated cylindrical hull 11 for maintaining the drifter buoy 10 at a substantially predetermined depth in water, preferably at or near the water's surface, as depicted in FIG. 1 and for orientation of the drifter buoy 10 with its longitudinal axis in a substantially vertical position. The drifter buoy 10 may be supplied with an antenna or sensor mast 12 which may be raised by an antenna deployment member 14. Alternatively, the buoy may be supplied with means to record and store data for recovery within the buoy.

In this preferred embodiment of the present invention as depicted in FIG. 1 the apparatus or assembly 1 is comprised of a collar 20 which is secured about the cylindrical hull 11 of the buoy 10 proximal the top of the buoy. The collar 20 has a plurality of radial battens 23, in this case four, which are pivotally connected by hinges 21 to the collar 20. The battens 23 present a multiplicity of outwardly projecting apices which are equidistantly and radially spaced in a common plane substantially perpendicular to the longitudinal axis of the cylindrical hull when the assembly is in the erect or deployed position. The battens 23 supply means for suspending a plurality of flexible vanes or sails 40 which project vertically downward and are mounted onto the cylindrical hull by central mounting member 41 thus providing a plurality of flat planes held perpendicular to the flow of water in which the drifter buoy 10 and accompanying assembly 1 are placed.

It can readily be seen that the vanes' or sails' main purpose is to provide horizontal drag which causes the buoy 10 to move in the body of water in which it is placed. This allows the buoy and associated assembly to accomplish the primary function of tracking the specific body of water.

The assembly 1 may also be provided with a series of floats 24 secured to the ends of the battens 23 remote from the collar 20. These can be attached to the battens 23 directly as shown in FIG. 1 or by short float suspending means as shown in FIG. 2 by float cords 25.

Figure 2:
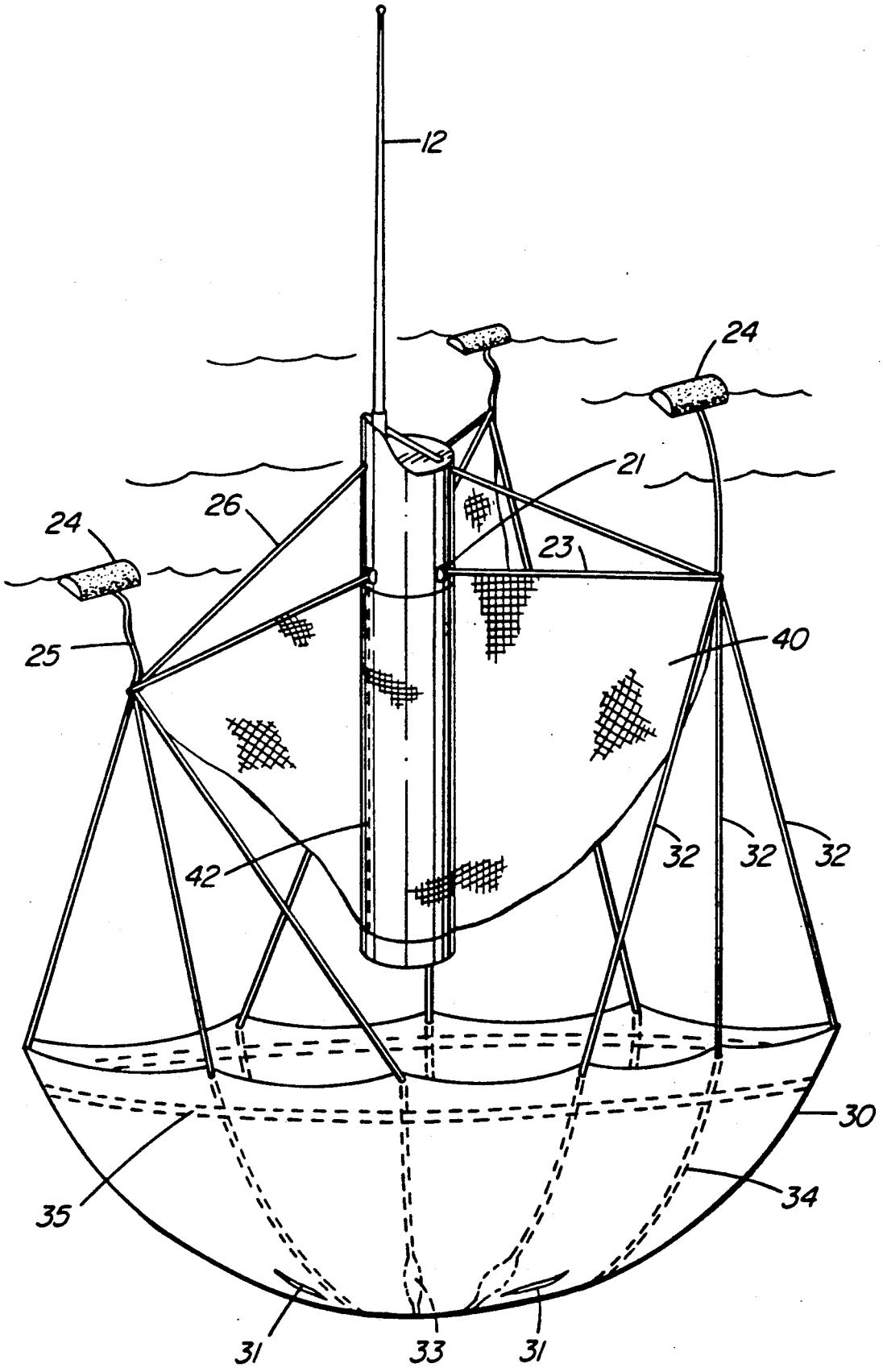
FIG. 2 is a perspective view of another embodiment of the SLDB employing three vanes and illustrating the use of floats suspended from the radial battens or batten arms.

If the floats 24 are suspended from float cords 25, they can be larger and easily packaged along a cylindrical hull 11 between the folded radial battens 23 and when deployed concentrate upward force through the cord at the end of the batten 23 for maximum effect as shown in FIG. 2. The floats 24 may be comprised of styrofoam or other suitable material and provide the upward force on the radial battens 23 to work against the damper which is embodied here as parachute 30.

Compliant members or tethers 26 may also be utilized to facilitate deployment of the radial battens 23 of the stabilizing assembly 1.

Although both the embodiments depicted in FIGS. 1 and 2 illustrate the use of the tethers 26 which is preferred, tethers may be eliminated when the floats 24 are of a size to provide sufficient buoyant force to facilitate deployment of the battens unassisted by tethers. The compliant members 26 are comprised of a light elastic material such as elastic or Bungy TM cord or the like. As shown in either FIGS. 1 or 2, the compliant tethers 26 are mounted at one end of each tether to the end of the batten remote the buoy and at the other end to the top of the buoy. The force generated by the tethers is greater when the batten is depressed and least when horizontal. The effect is similar in that it provides an upward and compliant force to work against the shroud 32 connected to the damper depicted as parachute 30.

Figure 3:
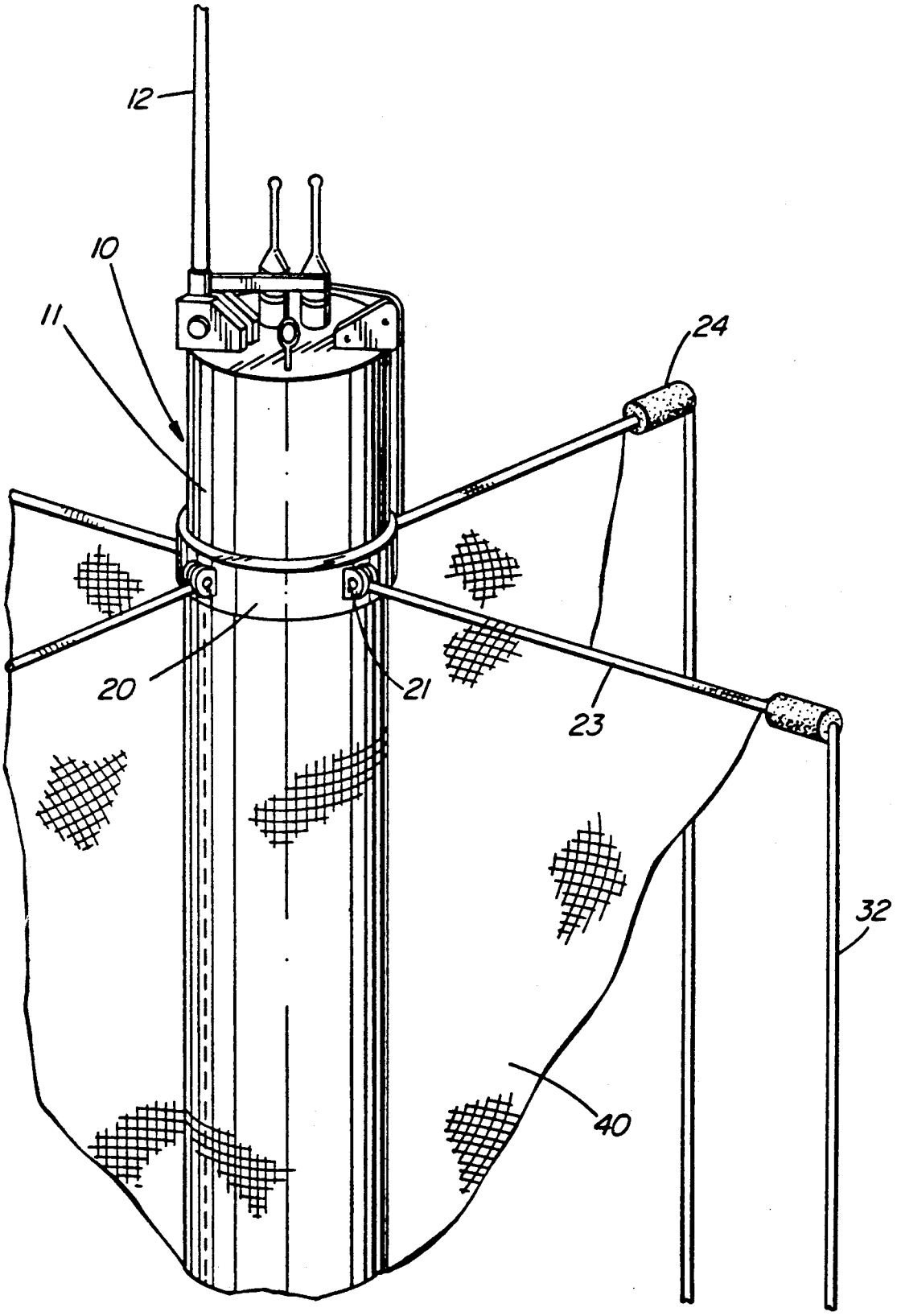
FIG. 3 is a fragmentary side view of the SLDB illustrated in FIG. 1 showing the collar and hinged radial battens. The compliant tethers have been deleted thus depicting a further embodiment of the present invention.

As shown in FIG. 1 and more particularly in FIG. 3, the battens 23 may be pivotally mounted via hinges 21 on collar 20 which is secured about the hull of the cylindrical hull 11. Alternatively, as depicted in FIG. 2, the radial battens may be pivotally mounted via hinges 21 directly on the cylindrical hull 11.

It should be understood that the compliant members 26 may not be required when the floats 24 are of a sufficient size to adequately erect the sails 40 via battens 23. Such an arrangement is depicted in FIG. 3. Furthermore, for proper functioning of the device, it is most important that the floats alone or the floats working in conjunction with the compliant members 26 provide sufficient upward force to the battens to prevent the collapse of the battens both horizontally or vertically. Collapse in either direction would severely reduce or eliminate the plane surface acting against the horizontal current within the layer of water.

The assembly 1 also includes a parachute 30 which provides drag to hold the drifter buoy 10 at its predetermined depth through restriction of upward movement to buoy and assembly. The parachute 30 is suspended from the ends or apices of the battens 23 by the parachute shroud or shroud lines 32.

When air deployed, the parachute 30 remains attached after the drifter buoy 10 enters the water. The parachute 30 has weights 33 sewn into the seams 34. The attachment of the shroud 32 at the ends of the battens 23 is such that as the battens 23 extend under the force of the floats 24, the parachute 30 is held open and in the inverted position. A stiffening band 35 may also be sewn into the parachute edge. This is particularly desirable when the assembly includes only three battens as depicted in FIG. 2. The vanes or sails 40 and the side of the parachute 30 provides a combined sail against horizontal flow of water within the water layer causing the drifter buoy 10 to remain within the water mass in which it is deployed.

It is to be understood that the parachute 30, as depicted in FIGS. 1 & 2 is a preferred embodiment and this element may be replaced by other suitable dampening elements suspended below the buoy such as a cloth bucket or a solid plate (not shown) provided the element is sufficient to impede vertical displacement of the buoy.

If the buoy were to become tilted due to wave action or the like, then any of the vanes 40 will not rise out of the water because of the hinge 21 at the collar 20 and due also to the fact that the float 24 is lighter than water but heavier than the air. Further, the floats 24 due to their location at the ends of the battens together with the compliant nature of the tethers 26, if present, provide maximum righting moment to keep the drifter buoy 10 in the vertical position. These compliant tethers 26 also assist in raising the battens 23 at deployment and in acting against the damper. The parachute 30, attached as shown in either of FIGS. 1 or 2 provides substantial retarding and compliant forces to upward motion of the drifter buoy 10. The drifter buoy 10 is a cylinder, the physics of which normally cause it to want to lie on its side in water and to raise out of the water when passing over a wave crest and then accelerate into the wave trough. The arrangement acts to keep the buoy upright and in the surface layer even when in a wave field.

Figure 4:
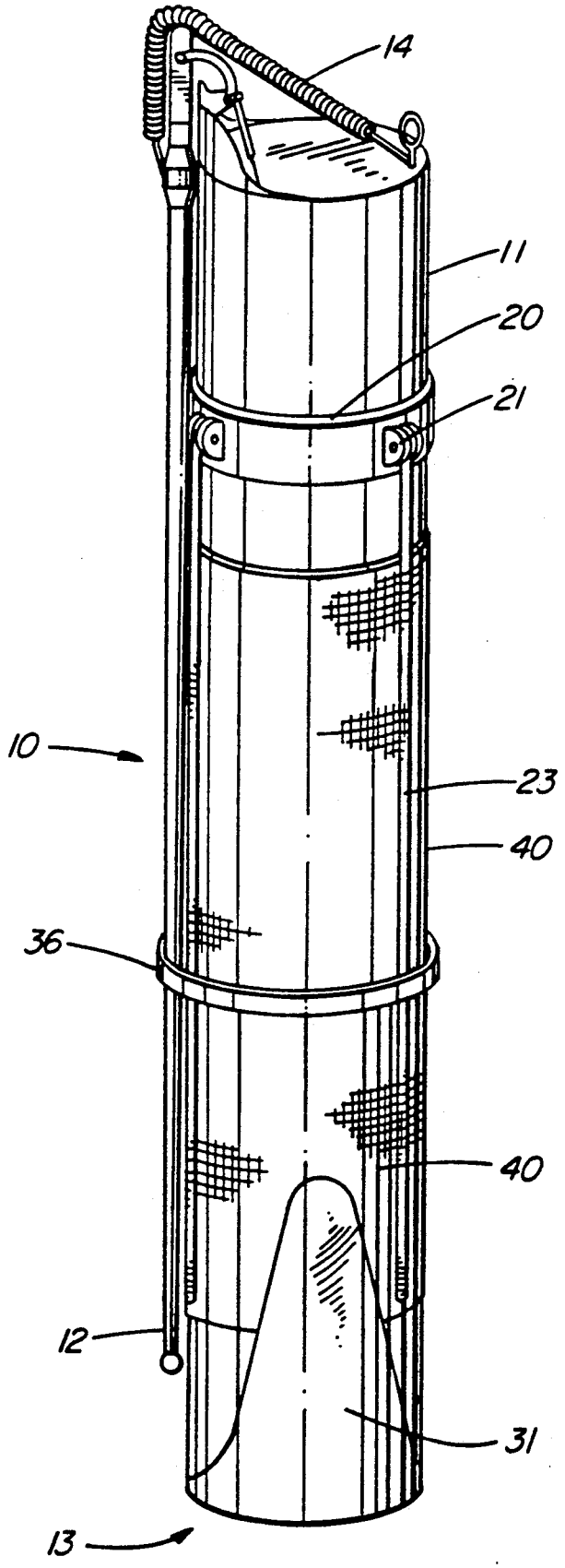
FIG. 4 is a front elevation, partially in perspective, of a SLDB according to the present invention as carried in an aircraft or other vehicle prior to deployment in the ocean.

The drifter buoy 10 of the present invention is carried in an aircraft or other vehicle prior to deployment in a body of water is depicted in FIG. 4. In this preferred embodiment as shown in FIG. 4, the drifter buoy 10 includes an antenna or sensor mast 12 which is spring actuated via antenna deployment member 14 once the buoy is deployed in the surface layer of the water. The deployment member 14 may be of suitable elastic material such as a Bungy TM cord material or the like. In this predeployment configuration, the batten arms or radial battens 23 are folded longitudinally along the sides of the buoy's cylindrical hull 11 as shown in FIG. 1.

The drifter buoy 10 is deployed from the aircraft or other vessel in the inverted position and the parachute 30 is deployed from the bottom end 13 of the cylindrical hull 11. A wind flap 31 may be used to aid in deployment of the parachute 30. The wind flap 31 is folded against the outside of the hull 11 and is connected via a cord to the parachute 30 located within the hull of the buoy. When deployed, the wind snaps the wind flap open facilitating deployment of the parachute.

The parachute 30, as shown in FIGS. 1 or 2, is attached to the apices of the batten arms or radial battens 23 by a parachute shroud comprised of a series of parachute lines 32. When in the air, parachute lines 32 tend to keep the battens 23 against or in close proximity to the buoy's cylindrical hull 11. The battens 23 are also taped in place with a water soluble tape 36. Once in the water the natural buoyant forces of the drifter buoy cause it to orient itself with the parachute 30 down. Once oriented, the dissolution of the water soluble tape 36 allows for the deployment of the assembly as is shown, for example, in FIGS. 1 and 2.

The buoy itself is weighted such that it is heavier at its bottom end. This feature combined with the timed-release of the water soluble tape 36 provides sufficient time for the buoy to orient itself in the upright position and to allow also for the sinking of the parachute 30 to a position below the buoy. The "timed" deployment of the assembly prevents possible entanglement of the parachute shroud and tearing of the assembly which would be associated with rapid deployment.

When monitoring the surface layer of the water, which is preferred, it is important to keep the Surface Lagrangian Drifter Buoy (SLDB) in the surface layer so that as true as possible an average horizontal flow rate can be tracked. A cylinder will rise out of the water as it rides over a wave crest and then surf down into the trough of the wave. During this surfing phase the wind greatly affects its speed and direction. This action generates a significant error in drift velocity and drift direction calculation. Both speed and direction can be grossly distorted. To stop the SLDB from rising out of the water the parachute used in air deployment is not discarded but kept in place with the shroud lines 32 tied at the ends of the batten arms or radial battens 23 as shown in FIGS. 1 or 2. The effect is that as the buoy starts to rise it must carry the parachute 30 full of water with it. The open parachute 30 aids in stabilizing the drifter buoy 10 due to its apparent weight because of the water weight above it. The parachute 30 may be supplied with small slits 31 in it allowing some water to escape and give the action of a shock absorber, i.e. a large retarding force to stop sharp movement, softer response to slower events.

Of primary importance in maintaining the drifter buoy 10 at a substantially predetermined depth in the water is the production of horizontal drag by the assembly which is accomplished by the fitting of sails or drag vanes 40. The drag vanes can be made from any strong flexible material such as sail cloth, Nylon ®, PVC (polyvinyl chloride) cloth, or Mylar ® sheet. The best drag element is a flat plane held perpendicular to the flow. Thus, as depicted in either FIGS. 1 or 2, the drag vane 40 when the assembly is in the deployed position is suspended from each radial batten 23 projecting downwardly therefrom. Each sail or drag vane 40 forms a flat plane two of which are perpendicular at any given time to the flow of water and is secured to the cylindrical hull 11 via a central mounting member 41. The sails or vanes 40 and the central mounting member 41 are preferably both comprised of the same material and are separated each by a longitudinal seam line 42.

It is conceivable that the Surface Lagrangian Drifter Buoy 10 may be constructed with a single sail held by a frame. This configuration will work well if the frame can be such that it can keep the sail always perpendicular to the flow. A three or four vaned configuration is easily made symmetric around the buoy's cylindrical hull 11. These latter configurations as depicted in FIGS. 2 and 1 respectively are more stable because maintenance of perpendicularity to the flow is inherent in the placement of the vanes. Adding more than four vanes does not enhance performance. The three vane version as shown in FIG. 2 is less than ideal for connecting to the parachute 30 and thus the four vane or sail embodiment is most preferred.

It can be seen from the foregoing that the assembly of the present invention keeps a buoy in the vertical position and moving within the water layer in which it is deployed. That the assembly is compliant, all forces balancing rather than in a rigid structure, is a positive and unique attribute with reference to its ability to function for extended periods of time without damage yet without the need for inordinately strong or expensive materials.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

The embodiments of the invention in which an exclusive property or privilege is claimed are defined as follows:

1. An apparatus for use in combination with a buoy having a generally elongated cylindrical hull for maintaining said buoy at a substantially predetermined depth in water and for orientation of said buoy with its longitudinal axis in a substantially vertical position, said apparatus comprising collapsible longitudinal stabilizer means including connection means for attachment to said elongated cylindrical hull of a buoy, for providing horizontal drag for facilitating and maintaining the buoy positionally within a desired layer of water wherein said connection means comprises a plurality of radial battens for pivotal connection to the cylindrical hull of said buoy, and a plurality of floats located at the apex of each said radial batten remote from said buoy and a collapsible vertical stabilizer means suspended below and transverse of the longitudinal axis of said buoy for impeding the vertical motion thereof.

2. The apparatus of claim 1 wherein the vertical stabilizer means is a dampening element formed of a material selected from the group consisting of a cloth bucket and a solid plate.

3. An apparatus for use in combination with a buoy having a generally elongated cylindrical hull for maintaining said buoy at a substantially predetermined depth in water and for orientation of said buoy with its longitudinal axis in a substantially vertical position, said apparatus comprising collapsible longitudinal stabilizer means including connection means for attachment to said elongated cylindrical hull of a buoy, for providing horizontal drag for facilitating and maintaining the buoy positionally within a desired body of water wherein said connection means comprises a plurality of radial battens for pivotal connection to the cylindrical hull of said buoy, and a plurality of floats located at the apex of each of said radial batten remote from said buoy and a collapsible vertical stabilizer means being located below and transverse of the longitudinal axis of said buoy for impeding the vertical motion thereof.

4. The apparatus of claim 3 wherein said battens present a multiplicity of outwardly projecting apices equidistant from a common center and radially spaced in a common plane substantially perpendicular to the longitudinal axis of said elongated cylindrical hull of said buoy, when said apparatus is in the erect or deployed position.

5. The apparatus of claim 4 wherein said collapsible longitudinal stabilizer means is formed from a plurality of drag vanes.

6. The apparatus of claim 5 wherein said drag vanes are made of a strong flexible sheet material selected from the group consisting of sail cloth, Nylon ®, PVC (polyvinyl chloride) cloth and Mylar ®.

7. The apparatus of claim 4 wherein said plurality of radial battens is 4 located equidistantly about said cylindrical buoy and in a common plane with one another, said plane being substantially perpendicular to the longitudinal axis of said buoy.

8. The apparatus of claim 4 wherein said plurality of radial battens is three equidistantly about said cylindrical buoy and in a common plane with one another, said plane being substantially perpendicular to the longitudinal axis of said buoy.

9. The apparatus of claim 4 wherein said radial battens are provided with deployment means to facilitate erection thereof in the water.

10. The apparatus of claim 9 wherein said deployment means further includes the use of compliant tethers, one for each batten to augment erection thereof.

11. The apparatus of claim 4 wherein said collapsible vertical stabilizer means is comprised of a parachute.

12. The apparatus of claim 11 wherein said parachute is suspended via parachute lines from the apex of each radial batten.

13. The apparatus of claim 3 wherein one each of said floats is suspended via suspension means from the apex of each radial batten.

14. The apparatus of claim 3 wherein said collapsible vertical stabilizer means is a dampening element selected from the group consisting of a parachute and cloth bucket.

15. The apparatus of claim 14 wherein said parachute has a series of small slit holes to allow for passage of water therethrough.

16. An apparatus for use in combination with a buoy having a generally elongated cylindrical hull for maintaining said buoy at a substantially predetermined depth in water and for orientation of said buoy with its longitudinal axis in a substantially vertical position, said apparatus comprising a collar for securing to an elongated cylindrical hull of a buoy, said collar having a plurality of radial battens pivotally connected thereto, said radial battens presenting a multiplicity of outwardly projecting apices equidistant from a common center and radially spaced in a common plane substantially perpendicular to the longitudinal axis of said elongated cylindrical hull when in the erect or deployed position, a plurality of floats located at the apex of each of said radial batten remote from said buoy, a plurality of flexible vanes mounted on said battens and projecting downwardly from said battens, said vanes being mounted to the hull of the buoy thereby presenting longitudinal vane means providing horizontal drag; and a damping element suspended below said buoy and substantially transverse its longitudinal axis for impeding the vertical motion of said buoy.

17. The apparatus of claim 16 wherein said dampening element is suspended from the apices of the battens via shroud lines.

18. The apparatus of claim 17 wherein said dampening element is formed by an inverted parachute.

* * * * *